US008910730B2

(12) United States Patent
Griffin et al.

(10) Patent No.: US 8,910,730 B2
(45) Date of Patent: Dec. 16, 2014

(54) CUTTING ELEMENT

(75) Inventors: Nigel D. Griffin, Gloucestershire (GB); Peter R. Hughes, Gloucestershire (GB)

(73) Assignee: National Oilwell Varco, L.P., Houston, TX (US)

( * ) Notice: Subject to any disclaimer, the term of this patent is extended or adjusted under 35 U.S.C. 154(b) by 331 days.

(21) Appl. No.: 12/704,017

(22) Filed: Feb. 11, 2010

(65) Prior Publication Data

US 2010/0200305 A1 Aug. 12, 2010

(30) Foreign Application Priority Data

Feb. 9, 2009 (GB) ..... 0901984.5

(51) Int. Cl.

| | |
|---|---|
| ***E21B 10/567*** | (2006.01) |
| ***B22F 7/06*** | (2006.01) |
| ***C22C 26/00*** | (2006.01) |
| ***C22C 29/08*** | (2006.01) |
| *B22F 5/00* | (2006.01) |

(52) U.S. Cl.

CPC ..... *E21B 10/567* (2013.01); *B22F 7/06* (2013.01); *C22C 26/00* (2013.01); *C22C 29/08* (2013.01); *E21B 10/5676* (2013.01); *B22F 2005/001* (2013.01); *B22F 2999/00* (2013.01)

USPC ..... 175/434; 175/426

(58) Field of Classification Search

USPC ..... 175/426, 433, 434

See application file for complete search history.

(56) References Cited

U.S. PATENT DOCUMENTS

| | | | |
|---|---|---|---|
| 2,992,900 | A | 7/1961 | Bovenkerk |
| 3,141,746 | A | 7/1964 | De Lai |
| 3,141,885 | A | 7/1964 | Ross et al. |
| 3,148,161 | A | 9/1964 | Bovenkerk et al. |
| 3,574,580 | A | 4/1971 | Stromberg et al. |
| 3,744,982 | A | 7/1973 | Bovenkerk et al. |
| 3,831,428 | A | 8/1974 | Wentorf, Jr. et al. |
| 3,913,280 | A | 10/1975 | Hall |
| 4,268,276 | A | 5/1981 | Bovenkerk |
| 4,288,248 | A | 9/1981 | Bovenkerk et al. |
| 4,534,773 | A | 8/1985 | Phaal et al. |
| 5,011,509 | A | 4/1991 | Frushour |

(Continued)

FOREIGN PATENT DOCUMENTS

| | | |
|---|---|---|
| EP | 1 190 791 A2 | 3/2002 |
| GB | 2 453 435 | 4/2009 |

(Continued)

OTHER PUBLICATIONS

SPS, 'What'SPS?' [online], 8 pages, Japan, [retrieved Oct. 24, 2011], Retrieved from Internet<URL: http://www.scm-sps. com/e_htm/ whatsps e_htm/whatsps e.htm>.

(Continued)

*Primary Examiner* — Cathleen Hutchins
*Assistant Examiner* — Taras P Bemko
(74) *Attorney, Agent, or Firm* — JL Salazar Law Firm

(57) ABSTRACT

A cutting element includes a multilayer polycrystalline diamond element bonded to a substrate of a less hard material. The polycrystalline diamond element defines a matrix of interstitial volumes. The interstitial volumes of a first region of the diamond layer are adjacent a working surface thereof being substantially free of a catalyzing material. The interstitial volumes of a second region of the diamond layer are remote from the working surface containing the catalyzing material.

23 Claims, 2 Drawing Sheets

(56) References Cited

U.S. PATENT DOCUMENTS

| | | | | |
|---|---|---|---|---|
| 5,011,514 | A | 4/1991 | Cho et al. | |
| 5,106,391 | A | 4/1992 | Lloyd | |
| 5,127,923 | A | 7/1992 | Bunting et al. | 51/293 |
| 5,433,280 | A | 7/1995 | Smith | |
| 5,510,193 | A | 4/1996 | Cerutti et al. | |
| 5,544,550 | A | 8/1996 | Smith | |
| 5,645,617 | A | 7/1997 | Frushour | |
| 5,776,615 | A | 7/1998 | Wong et al. | |
| 5,839,329 | A | 11/1998 | Smith et al. | |
| 5,957,006 | A | 9/1999 | Smith | |
| 5,981,057 | A | 11/1999 | Collins | |
| 6,041,875 | A | 3/2000 | Rai et al. | |
| 6,045,440 | A | 4/2000 | Johnson et al. | |
| 6,063,333 | A | 5/2000 | Dennis | |
| 6,193,001 | B1 | 2/2001 | Eyre et al. | |
| 6,200,514 | B1 | 3/2001 | Meister | |
| 6,209,420 | B1 | 4/2001 | Butcher et al. | |
| 6,344,149 | B1 * | 2/2002 | Oles | 216/11 |
| 6,353,771 | B1 | 3/2002 | Southland | |
| 6,454,030 | B1 | 9/2002 | Findley et al. | |
| 6,544,308 | B2 | 4/2003 | Griffin et al. | 51/309 |
| 6,601,662 | B2 | 8/2003 | Matthias et al. | 175/374 |
| 6,655,481 | B2 | 12/2003 | Findley et al. | |
| 6,852,414 | B1 | 2/2005 | Frushour | |
| 6,861,098 | B2 | 3/2005 | Griffin et al. | |
| 7,384,436 | B2 | 6/2008 | Sung | |
| 7,407,012 | B2 | 8/2008 | Keshavan et al. | |
| 7,435,478 | B2 | 10/2008 | Keshavan | |
| 7,493,973 | B2 * | 2/2009 | Keshavan et al. | 175/434 |
| 7,533,740 | B2 * | 5/2009 | Zhang et al. | 175/432 |
| 7,588,108 | B2 | 9/2009 | Miyao | |
| 7,862,634 | B2 | 1/2011 | Belnap et al. | |
| 7,862,932 | B2 | 1/2011 | Eguchi et al. | |
| 7,963,348 | B2 | 6/2011 | Laird et al. | |
| 7,972,409 | B2 | 7/2011 | Fujino et al. | |
| 2005/0044800 | A1 | 3/2005 | Hall et al. | |
| 2005/0115744 | A1 * | 6/2005 | Griffin et al. | 175/434 |
| 2006/0060391 | A1 | 3/2006 | Eyre et al. | 175/434 |
| 2006/0060392 | A1 | 3/2006 | Eyre | 175/434 |
| 2006/0191723 | A1 | 8/2006 | Keshavan | |
| 2006/0266559 | A1 * | 11/2006 | Keshavan et al. | 175/428 |
| 2007/0039762 | A1 | 2/2007 | Achilles | 175/434 |
| 2007/0277651 | A1 | 12/2007 | Calnan et al. | |
| 2008/0028891 | A1 | 2/2008 | Calnan et al. | |
| 2008/0142275 | A1 * | 6/2008 | Griffin et al. | 175/425 |
| 2009/0166094 | A1 | 7/2009 | Keshavan et al. | 175/374 |

FOREIGN PATENT DOCUMENTS

| | | |
|---|---|---|
| GB | 2 455 425 | 6/2009 |
| GB | 2467570 B | 8/2010 |
| WO | WO 02/24601 | 3/2002 |
| WO | WO 02/24603 | 3/2002 |

OTHER PUBLICATIONS

GB Search Report for counterpart GB Application No. GB0901984.5 dated Jun. 26, 2009.

GB Examination Report for counterpart GB Application No. GB0901984.5 dated May 11, 2012.

Aug. 21, 2012 Notification of Grant from counterpart UK Patent No. GB2467570, pp. 1-2.

* cited by examiner

CUTTING ELEMENT

CROSS REFERENCE TO RELATED APPLICATIONS

This application claims priority from GB Provisional Patent Application file No. 0901984.5 filed on Feb. 9, 2009, which is incorporated by reference herein for all it contains.

BACKGROUND OF THE INVENTION

1. Field of the Invention

This invention relates to a cutting element and in particular a cutting element suitable for use on a drill bit for use in the formation of boreholes.

2. Description of the Related Art

One form of cutting element for use on a drill bit comprises a table of superhard material, for example polycrystalline diamond, which is bonded to a substrate of a less hard material, for example tungsten carbide. Cutting elements of this type are well known and are available in a range of shapes and sizes for use in a range of applications.

This type of cutting element is manufactured using a high temperature, high pressure process in which a tungsten carbide substrate element, diamond powder and a binder catalyst, for example in the form of cobalt, are exposed to high temperature, high pressure conditions, resulting in the formation of chemical bonds between the diamond crystals of the diamond powder to form a polycrystalline diamond layer which is also bonded to the substrate element.

The polycrystalline diamond layer defines a matrix of interstitial volumes containing the binder catalyst material. It has been found to be advantageous to remove the binder catalyst material from at least the interstitial volumes located adjacent a working surface of the cutting element, as described in, for example, WO 02/24603 and WO 02/24601, as such treatment results in the working surface being of improved abrasion and impact resistance.

In use, the exposed, untreated part of the diamond layer tends to wear more quickly than the treated part with the result that an unsupported, protruding lip forms, and this effect is particularly apparent where the treated layer, i.e. that from which the binder catalyst is removed, forms only a relatively small proportion of the overall depth of the diamond layer. In such arrangements, there is a risk of the unsupported lip fracturing. It is an object of the invention to provide a cutting element in which this disadvantage is of reduced effect.

BRIEF SUMMARY OF THE INVENTION

According to the present invention there is provided a cutting element comprising a multilayered polycrystalline diamond element including at least a first layer and a second layer, the diamond element being bonded to a substrate of a less hard material, the diamond element defining a matrix of interstitial volumes, the interstitial volumes of a first region of the diamond element adjacent a working surface thereof being substantially free of a catalyzing material, the interstitial volumes of a second region of the diamond element remote from the working surface containing catalyzing material.

The first and second layers may include diamond particles of different sizes. For example, the first layer may comprise fine particles, coarser particles being included in the second layer.

The first layer may comprise a first multimode diamond layer and the second layer may comprise a second multimode diamond layer. A third layer, for example of monomodal form, may also be provided.

The first layer may be of a first thickness and a second layer may be of a second, different thickness. The first thickness is preferably smaller than the second thickness. For example, the first thickness may be approximately 0.08 mm and the second thickness may be approximately 0.10 mm. A third layer may be provided, the third layer being of a third thickness, preferably greater than the first and second thicknesses. For example, the third thickness may be of approximately 0.12 mm.

The diamond element may be of thickness up to approximately 2 mm.

The first layer preferably has a first volume diamond density, the second layer having a second, different volume diamond density. The first volume diamond density is preferably greater than the second volume diamond density. For example, the first volume diamond density may be approximately 98% whilst the second volume diamond density may be in the range of 94% to 98%. A third layer may be provided which preferably has a third, lower volume diamond density, preferably less than 94%.

The layers may be arranged parallel to the working surface. Alternatively, the layers may be arranged concentrically or arrange to extend across the element.

The first region may extend through at least part of both the first layer and the second layer. Alternatively, it may extend through just part of the first layer, or may extend to the depth of the second layer.

The working surface may comprise an end working surface region and a side working surface region. The first region may be located adjacent just the end working surface region or, alternatively, may be located adjacent at least part of both the end working surface and the side working surface, or just adjacent at least part of the side working surface.

BRIEF DESCRIPTION OF THE DRAWINGS

The invention will further be described, by way of example, with reference to the accompanying drawings, in which.

DETAILED DESCRIPTION OF THE INVENTION AND THE PREFERRED EMBODIMENT

Figure 1:
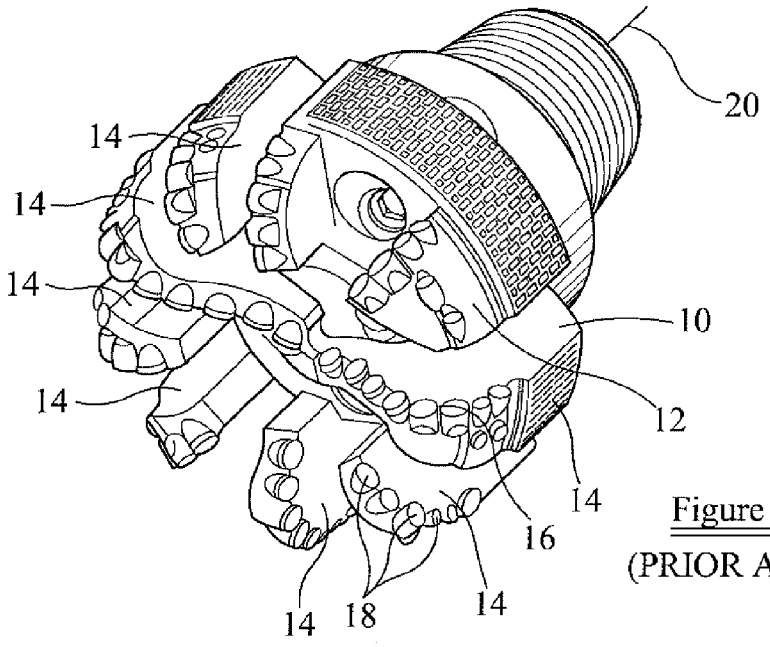
Figure 1 (PRIOR ART)
FIG. 1 is a perspective view of a known drill bit.

Referring firstly to FIG. 1 there is illustrated a drill bit comprising a bit body 12 formed with a plurality of outwardly extending blades 14. A front or leading edge 16 of each blade 14 carries a plurality of cutting elements 18. The cutting elements 18 are arranged such that, in use, rotation of the drill bit 10 about its axis 20 whilst an axially directed weight-on-bit loading is applied to the drill bit causes the cutting elements 18 to engage and bear against a formation, gouging, scraping, abrading or otherwise removing material from the formation, thereby extending a borehole being drilled using the drill bit 10.

Figure 2:
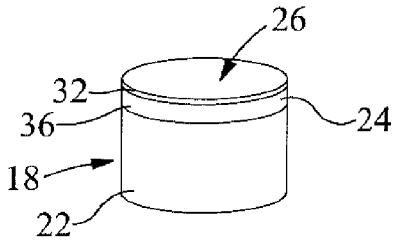
Figure 2 (PRIOR ART)
FIG. 2 is a view, illustrating a known cutting element.

As shown in FIG. 2, each cutting element 18 comprises a substrate 22 to which is integrally bonded an element 24 of a superhard material. The superhard material is polycrystalline diamond, and the substrate 22 is of a less hard material, for example tungsten carbide.

Figure 3:
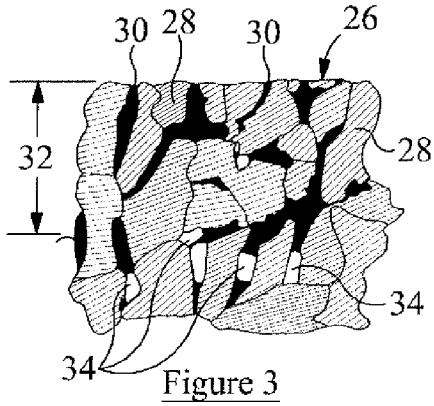
Figure 3 (PRIOR ART)
FIG. 3 is a diagrammatic sectional view illustrating part of the diamond layer of a known cutting element.

The element 24 of polycrystalline diamond has an end working surface 26, and is made up of diamond crystals 28 between which is formed a matrix of interstitial volumes or voids 30 (see FIG. 3). The element 24 has been treated such that the volumes or voids 30 of a first region 32 thereof located adjacent the working surface 26 are substantially free of a cobalt catalyzing material 34, the volumes or voids 30 of a second region 36 of the element 24 remote from the working surface 26 containing catalyzing material 34.

Figure 4:
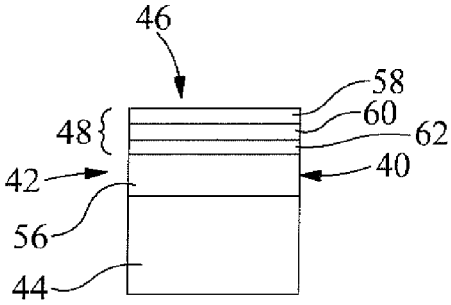
FIG. 4 is a sectional view illustrating a cutting element according to an embodiment of the invention.

FIG. 4 illustrates a cutting element 40 in accordance with an embodiment of the invention. The cutting element 40 is suitable for use on a drill bit as shown in FIG. 1, but it will be appreciated that it may be used on other drill bit designs. Like the cutting element 18 of FIG. 2, the cutting element 40 of the present invention comprises an element 42 of polycrystalline diamond integrally bonded to a substrate 44 of a less hard material, for example tungsten carbide. The element 42 defines an end working surface 46. A first region 48 of the element 42 adjacent the working surface 46 is treated so as to remove a cobalt catalyzing material from interstitial voids formed between the diamond crystals of the element 42 such that the first region 48 is substantially free of catalyzing material. A second region 56 of the element 42 remote from the working surface 46 is not treated, and so contains catalyzing material in interstitial voids thereof.

The first region 48 of the element 42 is itself of multi-layered form, comprising a first layer 58 adjacent the working surface 46, a second, intermediate layer 60, and a third layer 62 remote from the working surface 46. The first and second layers 58, 60 are both of multi-mode form, the diamond material of the third layer 62 being of monomode form. The first layer 58 is of a different thickness, preferably less than, the second layer 60. For example the first layer 58 may be of a first thickness of approximately 0.08 mm whilst the second layer is of a second thickness of approximately 0.10 mm. The third layer 62 may be of a thickness of approximately 0.12 mm and, overall, the diamond element 42 may have a total thickness of around 2 mm.

The first layer 58 preferably has a different, preferably higher, volume diamond density to the second layer 60. For example the first layer 58 may have a volume diamond density of around 98% whilst that of the second layer 60 may be in the range of 94% to 98%. The third layer 62 may have a lower volume diamond density, for example less than 94%. The first layer 58 may be of a finer particle size than the second layer 60, which may in turn be of finer particle size than the third layer 62.

Figure 5:
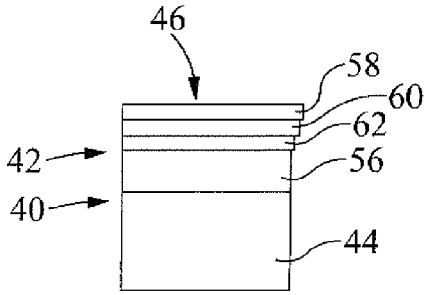
FIG. 5 is a view similar to FIG. 4 illustrating the cutting element in a worn condition.

Such an arrangement is advantageous in that, in use, as the cutting element 40 wears, the element 42 will tend to form a series of steps of different sizes, providing support for the part of the element 42 forming the working surface 46, as shown in FIG. 5. The cutting element 40 so formed is of good abrasion and impact resistance and would be suitable for use, for example, on the radially outer parts of a drill bit.

The first, second and third layers 58, 60, 62 are conveniently formed by appropriate layering of the diamond powder material used in the formation of the cutting element. For example, layers of different diamond powder materials may be introduced into a container, together with an insert forming the substrate and the binder catalyst material, before exposing the container and its contents to high temperature, high pressure conditions as outlined hereinbefore to fabricate the cutting element.

Although the cutting element 40 described hereinbefore makes use of the effects of different volume diamond densities, layer thicknesses, particle sizes and diamond structure, it will be appreciated that some of the benefits of the invention can be achieved by utilising only one or two of these effects.

Figure 6:
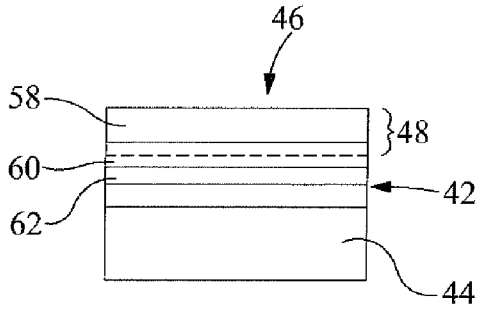
FIGS. 6 to 9 are views illustrating alternative embodiments of the invention.

In the arrangement illustrated in FIGS. 4 and 5, the first region 48 which has been treated to remove substantially all of the catalyzing material from the interstitial volumes extends from the working surface 46 to the depth of the boundary of the third layer 62 remote from the working surface 46. However, this does not need to be the case, and FIG. 6 illustrates an arrangement in which the first region 48 extends to a depth part-way through the second layer 60. Other depths are also possible within the scope of the invention. For example, the first region 48 may extend to a depth part-way through the first layer 58 or to the boundary between the first and second layers 58, 60.

Figure 7:
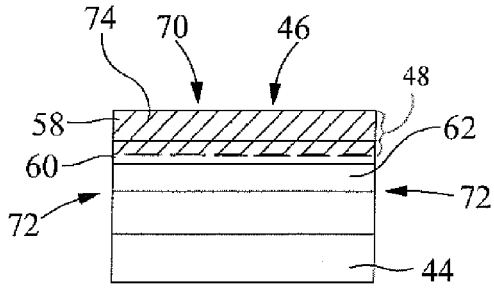
Figure 8:
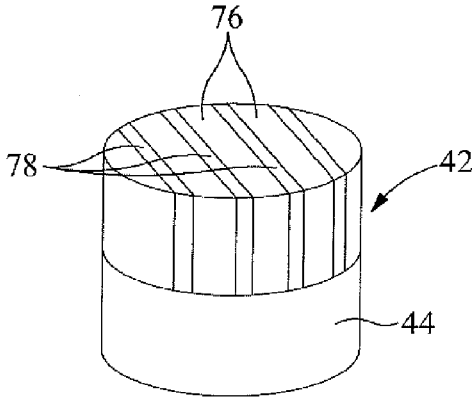
Figure 9:
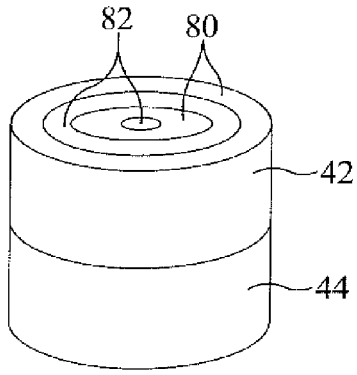

FIG. 7 illustrates an arrangement similar to that of FIG. 6 but in which the working surface 46 includes an end working surface region 70 and a side or peripheral working surface region 72, the first region 48 extending adjacent at least part of both working surface regions 70, 72 as indicated by the shaded region 74 in FIG. 7. Again, the depth to which the first region 48 extends, both from the end working surface region 70 and from the side working surface region 72 can be changed. In the arrangements of FIGS. 4 to 7 the layers 58, 60, 62 are parallel to the plane of the end working surface 46. Other arrangements are possible. For example FIG. 8 illustrates an arrangement in which layers 76, 78 of different diamond materials extend across the end working surface 46, the layers 76, 78 being perpendicular to the plane of the end working surface 46, and FIG. 9 illustrates an arrangement in which the layers 80, 82 are arranged concentrically. In either case, the first and second regions may be arranged as in any of the arrangements of FIGS. 4 to 7 and variants thereto as described hereinbefore.

A number of modifications and alterations may be made to the arrangements described hereinbefore without departing from the scope of the invention.

The invention claimed is:

1. A cutting element comprising:

a multilayered polycrystalline diamond element having a working surface comprising an end working surface and a peripheral working surface extending from the end working surface around the periphery of the element to a depth below the end working surface, the diamond element further comprising at least a first layer adjacent the end working surface and surrounded by the peripheral working surface, and a second layer below the first layer, the first layer comprising different diamond particles than the second layer, the first layer and the second layer sintered to a substrate of a less hard material, the polycrystalline diamond element defining a matrix of interstitial volumes, the interstitial volumes of a first region of the diamond element adjacent the working surface thereof being substantially free of a catalyzing material, the interstitial volumes of a second region of the diamond element remote from the working surface containing the catalyzing material, the first region of the diamond element extending from the end working surface and through the first layer and at least a portion of the second layer, the first region further extending through an area defined by the end working surface and at least part of the peripheral working surface and a depth extending below the end working surface, the first and second layers forming a series of steps of different sizes, the first layer adjacent to the working surface having a radius greater than a radius of the second layer.

2. The element according to claim 1, wherein the first layer includes relatively fine particles, the second layer including relatively coarse particles.

3. The element according to claim 1, wherein the first layer is of multi modal form.

4. The element according to claim 3, wherein the second layer is of multi modal form.

5. The element according to claim 1, wherein the first layer is of a first thickness and the second layer is of a second, different thickness.

6. The element according to claim 5, wherein the first thickness is smaller than the second thickness.

7. The element according to claim 6, wherein the first thickness is approximately 0.08 mm and the second thickness is approximately 0.10 mm.

8. The element according to claim 5, further comprising a third layer of thickness greater than the first and second layers.

9. The element according to claim 8, wherein the third layer is of thickness approximately 0.12 mm.

10. The element according to claim 5, wherein the first layer has a first volume diamond density, the second layer having a second, different volume diamond density.

11. The element according to claim 10, wherein the first volume diamond density is greater than the second volume diamond density.

12. The element according to claim 10, further comprising a third layer having a third, lower volume diamond density.

13. The element according to claim 5, wherein the first layer has a first volume diamond density of approximately 98% and the second layer has a second volume diamond density in the range of 94% to 98%.

14. The element according to claim 5, wherein the working surface consists of an end working surface region.

15. The element according to claim 1, wherein the first and second layers are arranged parallel to the end working surface.

16. The element according to claim 1, wherein the first layer is arranged perpendicularly to the end working surface.

17. The element according to claim 1, wherein the first layer is concentrically arranged.

18. The cutting element of claim 1, further comprising a third layer adjacent the second layer, the radius of the second layer being greater than the radius of the third layer.

19. The cutting element of claim 1, wherein the first region of the diamond element extends through the first and second layers.

20. A cutting element comprising:

a multilayered polycrystalline diamond element having a working surface comprising an end working surface and a peripheral working surface extending from the end working surface around the periphery of the element to a depth below the end working surface, the diamond element further comprising a first layer adjacent to the end working surface and surrounded by the peripheral working surface thereof comprising a diamond powder having a first diamond density, and a second layer below the first layer comprising a diamond powder having a second diamond density different from the first density, the diamond powder defining a matrix having interstitial volumes, the interstitial volumes of a first region of the diamond element being substantially free of a catalyzing material, the interstitial volumes of a second region of the diamond element containing the catalyzing material, the first region of the diamond element extending through the first layer and at least a portion of the second layer, the first region further extending through an area defined by the end working surface and at least a part of the peripheral working surface regions and a horizontal depth extending below the end working surface, the first and second layers forming a series of steps of different sizes, the first layer adjacent to the working surface having a radius greater than a radius of the second layer; and a substrate of less hard material, the first layer and the second layer sintered to the substrate.

21. The cutting element of claim 20, further comprising a third layer, the third layer comprising a diamond powder having a third diamond density.

22. The cutting element of claim 20, further comprising a third layer adjacent the second layer, the radius of the second layer being greater than the radius of the third layer.

23. The cutting element of claim 20, wherein the first region of the diamond element extends through the first and second layers.

* * * * *